US009150013B2

(12) United States Patent
Somete

(10) Patent No.: US 9,150,013 B2
(45) Date of Patent: Oct. 6, 2015

(54) INKJET RECORDING APPARATUS

(71) Applicant: KYOCERA Document Solutions Inc., Osaka (JP)

(72) Inventor: Takashi Somete, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/525,918

(22) Filed: Oct. 28, 2014

(65) Prior Publication Data

US 2015/0116401 A1 Apr. 30, 2015

(30) Foreign Application Priority Data

Oct. 31, 2013 (JP) ..... 2013-227057

(51) Int. Cl.
*B41J 2/045* (2006.01)

(52) U.S. Cl.
CPC ..... *B41J 2/04588* (2013.01); *B41J 2/04581* (2013.01)

(58) Field of Classification Search
CPC ..... B41J 29/393
See application file for complete search history.

(56) References Cited

U.S. PATENT DOCUMENTS

| | | | | |
|---|---|---|---|---|
| 5,880,750 | A * | 3/1999 | Takahashi | 347/10 |
| 6,428,134 | B1 * | 8/2002 | Clark et al. | 347/10 |
| 7,021,732 | B2 * | 4/2006 | Folkins | 347/8 |
| 2005/0088492 | A1 * | 4/2005 | Mita | 347/72 |
| 2008/0136856 | A1 * | 6/2008 | Azami et al. | 347/16 |
| 2009/0231614 | A1 * | 9/2009 | Oku | 358/1.15 |
| 2013/0182026 | A1 * | 7/2013 | Satake | 347/10 |

FOREIGN PATENT DOCUMENTS

JP 6-15815 A 1/1994

* cited by examiner

*Primary Examiner* — Stephen Meier
*Assistant Examiner* — John P Zimmermann
(74) *Attorney, Agent, or Firm* — Stein IP, LLC

(57) ABSTRACT

In an inkjet recording apparatus, when one set of image data is divided in the sub scanning direction into A bands, and nozzles are divided in the main scanning direction into groups each comprising A nozzles, a selector associates, within each of the group, the nozzles in the first to Ath columns with the first to Ath bands with no overlap, and, for a nozzle that is to discharge ink for one pixel or less within one set of image data, makes the nozzle perform preparatory discharge in the band associated with the nozzle by selecting, out of different ink discharge drive waveforms, a first drive waveform (1) corresponding to the minimum gradation.

6 Claims, 9 Drawing Sheets

INKJET RECORDING APPARATUS

INCORPORATION BY REFERENCE

This application is based upon and claims the benefit of priority from the corresponding Japanese Patent Application No. 2013-227057 filed on Oct. 31, 2013, the entire contents of which are incorporated herein by reference.

BACKGROUND OF THE INVENTION

The present disclosure relates to an inkjet recording apparatus which performs recording by discharging ink onto a recording medium such as paper in a recording apparatus such as a facsimile machine, copier, or printer, and relates in particular to recovery of a recording head which discharges ink.

A recording apparatus such as a facsimile machine, copier, or printer is configured to record an image on a recording medium such as paper, cloth, or OHP sheet. Depending on the method used for recording, a recording apparatus is classified into an inkjet type, a wire dot type, a thermal type, etc. An inkjet recording method can be further classified into a serial type, where recording is performed while a recording head scans across a recording medium, or a line head type, where recording is performed by a recording head fixed to the apparatus body.

In such an inkjet recording apparatus, with respect to discharge nozzles on standby for printing or between sheets during continuous printing, or discharge nozzles that remain unused during printing, no cap is attached. In addition, in a discharge nozzle that goes without discharging ink, moisture keeps evaporating from the ink inside it, and the ink comes to have increased viscosity. As a result, when the nozzle is later expected to discharge ink, inconveniently, it may discharge ink improperly or even fail to discharge ink.

In particular, in a line head recording method where a recording head is fixed, each nozzle of the recording head corresponds to one particular pixel (dot) in one line of an image. Thus, some nozzles, such as those corresponding to pixels in the left and right margins, go without discharging ink even once during printing of one image. These nozzles may later have to form dots for different image data, and therefore need to stay ready to discharge ink stably whenever actuated.

In a widely adopted design, discharge nozzles, which have openings on the ink discharge surface of a recording head, are prevented from ink dryout and ink clogging through a recording head recovery process which involves forcing ink out of the nozzles (purging) and then wiping off the ink deposited on the ink discharge surface (wiping). Inconveniently, through this process, a large amount of ink is dumped without being used, and is thus wasted. Moreover, forcible discharge is performed not only for nozzles that have not discharged ink but also for nozzles immediately after ink discharge. This is inefficient.

On the other hand, as a recording head for an inkjet recording apparatus, a piezoelectric inkjet head is widely used. In a piezoelectric inkjet head, the force produced by a piezoelectric element is transmitted, as a pressure, to ink inside a pressurizing chamber so that the pressure makes the ink meniscus inside a nozzle swing for generating ink droplets.

Thus, according to a conventionally proposed method, the ink meniscus inside a nozzle is oscillated in such a degree as not to discharge ink, with the aim of preventing nozzle clogging. However, such meniscus swinging stirs the ink inside the nozzle; thus, ink near the meniscus with increased viscosity due to evaporation of moisture is diffused deeper in the nozzle, and instead ink with no increase in viscosity moves toward the meniscus. Here, compared with ink with increased viscosity, which is short of moisture, ink with no increase in viscosity allows moisture to evaporate faster. Thus, ink near the meniscus tends to show a faster increase in viscosity.

As discussed above, performing meniscus swinging for a nozzle that does not form a dot even once within one sheet-worth image data contrarily prompts an increase in the viscosity of ink inside the nozzle, causing gradual degradation of ink dischargeability. Thus, after switching to image data for printing on the subsequent sheet, when a dot is formed by use of a nozzle that has formed no dot on the previous sheet, ink droplets may be discharged improperly.

In a conventionally known inkjet recording apparatus, ink with increased viscosity inside the nozzle is discharged with the aim of preventing ink clogging; that is, preparatory discharge (waste printing) is performed. In this inkjet recording apparatus, preparatory discharge is performed on paper, and thus there is no need to wipe the ink discharge surface of the recording head.

SUMMARY OF THE INVENTION

According to one aspect of the present disclosure, an inkjet recording apparatus is provided with a recording head, a head driver, and a controller. The recording head has a plurality of nozzles, a plurality of pressurizing chambers, and a plurality of piezoelectric elements. The plurality of nozzles discharge ink onto a recording medium. The plurality of pressurizing chambers communicate with the plurality of nozzles respectively, and are capable of containing the ink inside. The plurality of piezoelectric elements are arranged to correspond to the plurality of pressurizing chambers respectively, pressurize the ink inside the pressurizing chambers to discharge the ink from the nozzles respectively. The head driver includes a drive pulse generator, and makes the nozzles discharge amounts of ink determined respectively according to the gradations of the pixels constituting image data as a printing target. The drive pulse generator generates, as the drive waveform of drive voltages for the piezoelectric elements, one of a plurality of drive waveforms including two or more ink discharge drive waveforms set according to the number of times that the nozzles are to discharge the ink and a meniscus swinging drive waveform for swinging meniscuses inside the nozzles without discharging the ink. The controller has an image processor and a data processor. The image processor generates printing data in which the pixels constituting the image data as the printing target are represented in multivalued gradations respectively. The data processor generates, respectively for the pixels constituting the printing data generated in the image processor, drive waveform selection data corresponding to the gradations of the pixels. In at least one of the head driver and the controller, a selector is provided which selects, for the nozzles respectively, which of the drive waveforms to apply, or whether or not to apply any of the drive waveforms, to the piezoelectric elements, a. When one set of image data is divided in the sub scanning direction into A bands (where A is an integer of 2 or more), and the nozzles are divided in the main scanning direction into groups each comprising A nozzles, the selector associates, within each of the group, the nozzles in the first to Ath columns with the first to Ath bands with no overlap, and, for a nozzle that is to discharge ink for one pixel or less within the one set of image data, makes the nozzle perform preparatory discharge by selecting a drive waveform corresponding to the minimum gradation out of the ink discharge drive waveforms within the band associated with the nozzle.

Further features and advantages of the present disclosure will become apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Hereinafter, an embodiment of the present disclosure will be described with reference to the accompanying drawings.

Figure 1:
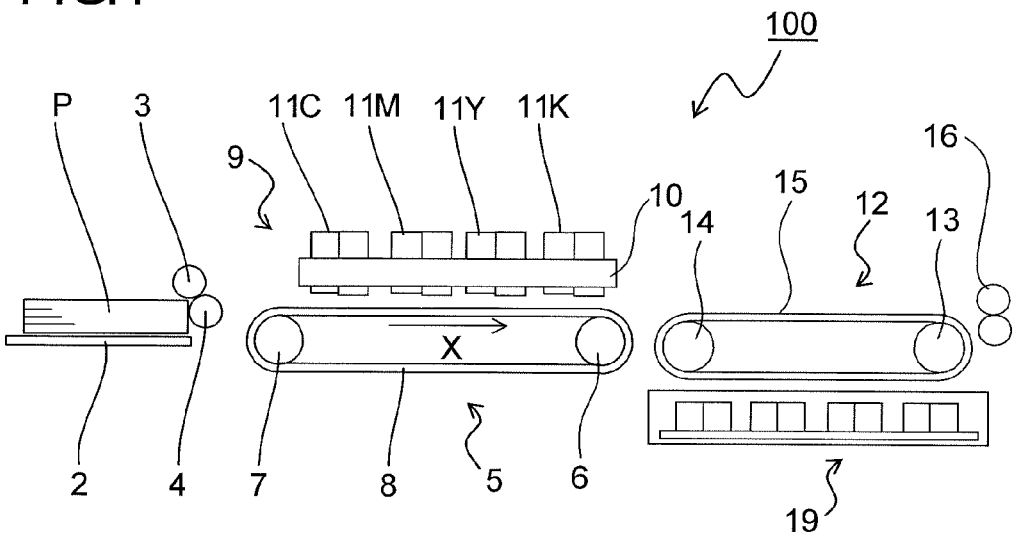
FIG. 1 is a side view showing a structure of an inkjet recording apparatus according to the present disclosure.

As shown in FIG. 1, an inkjet recording apparatus 100 according to one embodiment of the present disclosure is provided with, in a left side part thereof, a paper feed tray 2 for containing paper P (recording medium), and at one end of the paper feed tray 2, there are provided a paper feed roller 3 for transporting and feeding the contained paper P, sheet by sheet starting with the topmost sheet P, toward a first transport unit 5, which will be described later, and a driven roller 4 kept in pressed contact with the paper feed roller 3 to rotate by following it.

At the downstream side (right side in FIG. 1) of the paper feed roller 3 and the driven roller 4 with respect to the paper transport direction (direction indicated by arrow X), a first transport unit 5 and a recording portion 9 are arranged. The first transport unit 5 includes a first driving roller 6 and a first driven roller 7, which are arranged on the downstream and upstream sides, respectively, with respect to the paper transport direction, and a first transport belt 8 wound around the first driving roller 6 and the first driven roller 7. As the first driving roller 6 is driven to rotate clockwise, a sheet P held on the first transport belt 8 is transported in the direction indicated by arrow X.

Owing to the first driving roller 6 being arranged on the downstream side with respect to the paper transport direction, the transport surface (upper surface in FIG. 1) of the first transport belt 8 is pulled by the first driving roller 6. This increases the tension of the transport surface of the first transport belt 8, and allows stable transport of the paper P. Used as the first transport belt 8 is a sheet of a dielectric resin, and in particular a belt with no seam (seamless belt).

Figure 2:
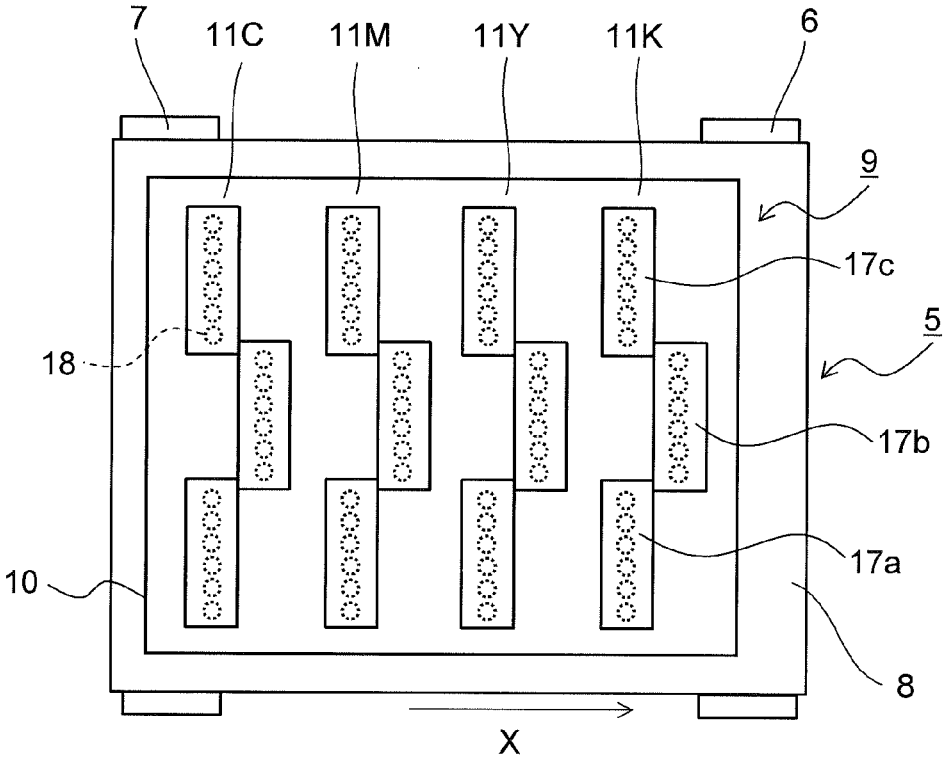
FIG. 2 is a plan view of a first transport unit and a recording portion in the inkjet recording apparatus shown in FIG. 1, as seen from above.

The recording portion 9 is provided with a head housing 10 and line heads 11C, 11M, 11Y, and 11K held on the head housing 10. These line heads 11C to 11K are held at such a height as to form a predetermined gap (for example, 1 mm) from the transport surface of the first transport belt 8, and each have, as shown in FIG. 2, a plurality of (here, three) recording heads 17*a* to 17*c* arrayed in a staggered formation along the paper width direction (up/down direction in FIG. 2), which is perpendicular to the paper transport direction. The line heads 11C to 11K have a recording region of which the width is greater than the width of the sheet P transported, and can discharge ink from whichever nozzles 18 corresponding to the printing position onto a sheet P being transported on the first transport belt 8.

The recording heads 17*a* to 17*c* constituting the line heads 11C to 11K are fed respectively with ink of four colors (cyan, magenta, yellow, and black) stored in respective ink tanks (not illustrated). Used as the recording heads 17*a* to 17*c* are piezoelectric inkjet heads which produce ink droplets by transmitting a pressure produced by deformation of a piezoelectric element 31 to ink inside nozzles 18 so as to swing meniscuses (see FIG. 3).

According to image data received from an external computer or the like, each recording head 17*a* to 17*c* discharges ink from the nozzles 18 toward a sheet P transported on, in a state held by attaching to, the transport surface of the first transport belt 8. Thus, on the sheet on the first transport belt 8, a color image is formed in which ink of four colors, namely cyan, magenta, yellow, and black, are overlaid together.

To prevent ink discharge failure resulting from dryout or clogging in the recording heads 17*a* to 17*c*, ink having increased viscosity in the nozzles is forced out, at the start of printing after prolonged disuse, from all the nozzles 18 of recording heads 17*a* to 17*c* and, between printing sessions, from whichever of the nozzles 18 of the recording heads 17*a* to 17*c* have discharged less than a prescribed amount of ink, to prepare for a subsequent printing session. This operation is called purging.

At the downstream side (right side in FIG. 1) of the first transport unit 5 with respect to the paper transport direction, a second transport unit 12 is arranged. The second transport unit 12 includes a second driving roller 13 and a second driven roller 14, which are arranged on the downstream and upstream side, respectively, with respect to the paper transport direction, and a second transport belt 15, which is wound around the second driving roller 13 and the second driven roller 14. As the second driving roller 13 is driven to rotate clockwise, a sheet P held on the second transport belt 15 is transported in the direction indicated by arrow X.

A sheet P having an ink image recorded on it in the recording portion 9 is fed to the second transport unit 12, and while it passes through the second transport unit 12, the ink deposited on the surface of the sheet P is dried. Under the second transport unit 12, a maintenance unit 19 is arranged. When the above-mentioned purging is performed, the maintenance unit 19 moves to under the recording portion 9, where the maintenance unit 19 wipes off and collects the ink forced out from the nozzles 18 of the recording heads 17.

At the downstream side of the second transport unit 12 with respect to the paper transport direction, a discharge roller pair 16 is arranged which discharges the sheet P having the image recorded on it out of the apparatus, and at the downstream side of the discharge roller pair 16, a discharge tray (not illustrated) is provided on which the sheet P discharged out of the apparatus is stacked.

Now, a description will be given of how the recording portion 9 is driven and controlled in the inkjet recording apparatus 100 according to the present disclosure. It should be noted that the operation of the inkjet recording apparatus 100 involves controlling different parts of the apparatus in various manners, and accordingly the control of the entire inkjet recording apparatus 100 proceeds across complicated control paths. To avoid complication, the following description focuses on, of all such control paths, those essential to implement the present disclosure. The recording heads 17*a* to 17*c* will henceforth be identified without the suffixes "a" to "c."

Figure 3:
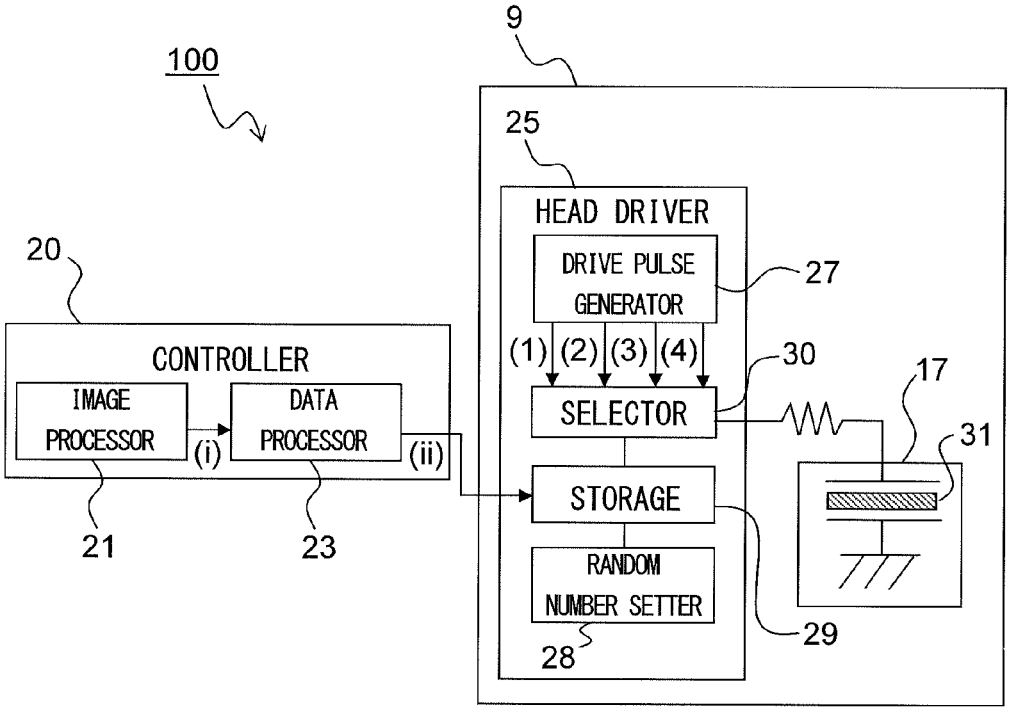
FIG. 3 is a block diagram showing an example of control paths used in an inkjet recording apparatus according to the present disclosure.

As shown in FIG. 3, the inkjet recording apparatus 100 is provided with a controller 20 which mainly controls image processing. The controller 20 includes an image processor 21, which generates printing data (i) in which the pixels constituting image data as a printing target are represented in multivalued gradations; and a data processor 23, which generates drive waveform selection data (ii) which indicates, for each of the pixels constituting the printing data (i), with which of a first to a fourth drive waveform (1) to (4), which will be described later, to apply a drive voltage to the piezoelectric element 31 of the nozzle 18 that discharges ink for that pixel, or whether or not to apply any drive voltage at all.

The recording portion 9 includes a recording head 17, which constitutes the line heads 11C to 11K (see FIG. 2) for the different colors; and a head driver 25, which drives the recording head 17. The head driver 25 makes the recording head 17 discharge, for each pixel of the image data as the printing target, ink once or more times according to the gradation of that pixel, and thereby records the image on a sheet.

The head driver 25 includes a drive pulse generator 27, which generates a first drive waveform (1), a second drive waveform (2), a third drive waveform (3), and a fourth drive waveform (4), which will be described later; a storage 29, which stores the drive waveform selection data (ii) transmitted from the data processor 23; a random number setter 28, which sets random numbers to the nozzles 18 respectively; and a selector 30, which either selects one of the first to fourth drive waveforms (1) to (4) based on the drive waveform selection data (ii) stored in the storage 29 and applies a drive voltage with the selected drive waveform to the piezoelectric elements 31 in the recording head 17 or selects none of the drive waveforms but keeps the drive voltage of the piezoelectric element 31 in the recording head 17 constant.

Figure 4:
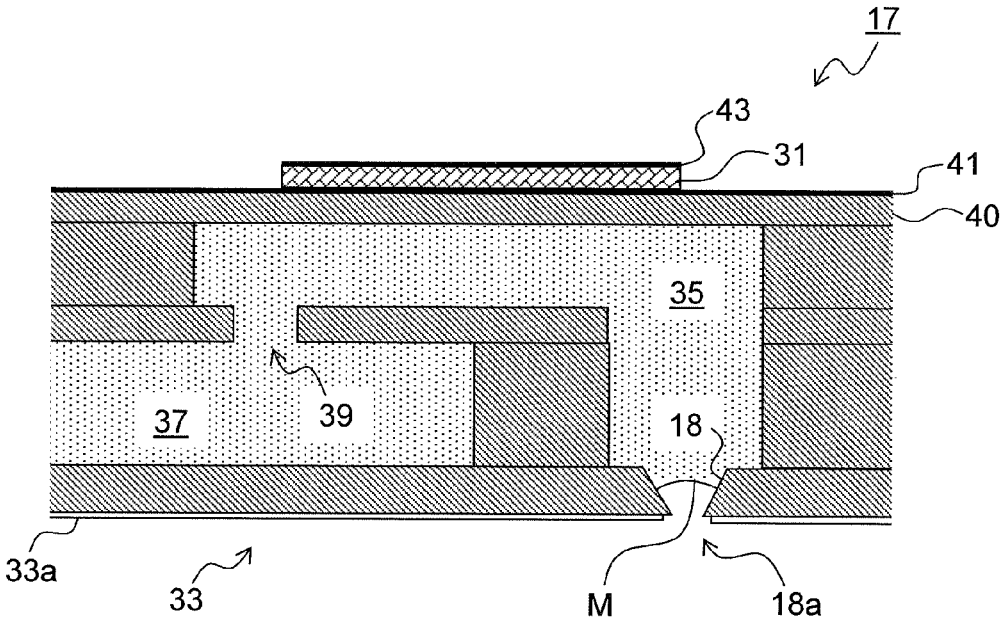
FIG. 4 is an enlarged sectional view showing a structure of a recording head.

The recording head 17 is, as shown in FIG. 2, of a line head type, and has, as shown in FIG. 4, a discharge surface 33 which faces paper. In the discharge surface 33, as the openings of the nozzles 18, a plurality of discharge ports 18*a* with a small diameter are arranged at least over the maximum width of the printing region in the longitudinal direction of the discharge surface 33 (i.e., the main scanning direction).

As shown in FIG. 4, the recording head 17 has a water-repellent film 33*a*, which covers the discharge surface 33 except over the discharge ports 18*a*; pressurizing chambers 35, which are provided one for each of the discharge ports 18*a*; and a common passage 37, through which ink is fed from an ink tank (not illustrated) where ink is stored to the plurality of pressurizing chambers 35. The pressurizing chambers 35 communicate with the common passage 37 through feed ports 39, and through these feed ports 39, ink is fed from the common passage 37 to the pressurizing chambers 35. The nozzles 18 are respectively continuous from inside the pressurizing chambers 35 to the discharge ports 18*a*. Of the walls of the pressurizing chambers 35, those opposite from the discharge surface 33 are formed by an oscillating diaphragm 40. The oscillating diaphragm 40 is continuous over the plurality of pressurizing chambers 35, and further on the oscillating diaphragm 40, a common electrode 41 is stacked which is formed likewise to be continuous over the plurality of pressurizing chambers 35. On the common electrode 41, piezoelectric elements 31 are provided one for each of the pressurizing chambers 35, and further on, individual electrodes 43 are provided one for each of the pressurizing chambers 35 so as to sandwich, with the common electrode 41, the piezoelectric elements 31.

Applying a drive pulse generated by the drive pulse generator 27 in the head driver 25 to an individual electrodes 43 causes the corresponding piezoelectric element 31 to be driven independently. The deformation of the piezoelectric element 31 resulting from the driving is transmitted to the oscillating diaphragm 40, which then deforms to compress the pressurizing chamber 35. As a result, a pressure is applied to the ink inside the pressurizing chamber 35, and this causes the ink to be discharged, through the nozzle 18, from the discharge port 18*a* in the form of a droplet onto paper. Even while no ink droplet is being discharged, ink is present inside the nozzle 18, where the ink forms a meniscus surfaces M.

Figure 5:
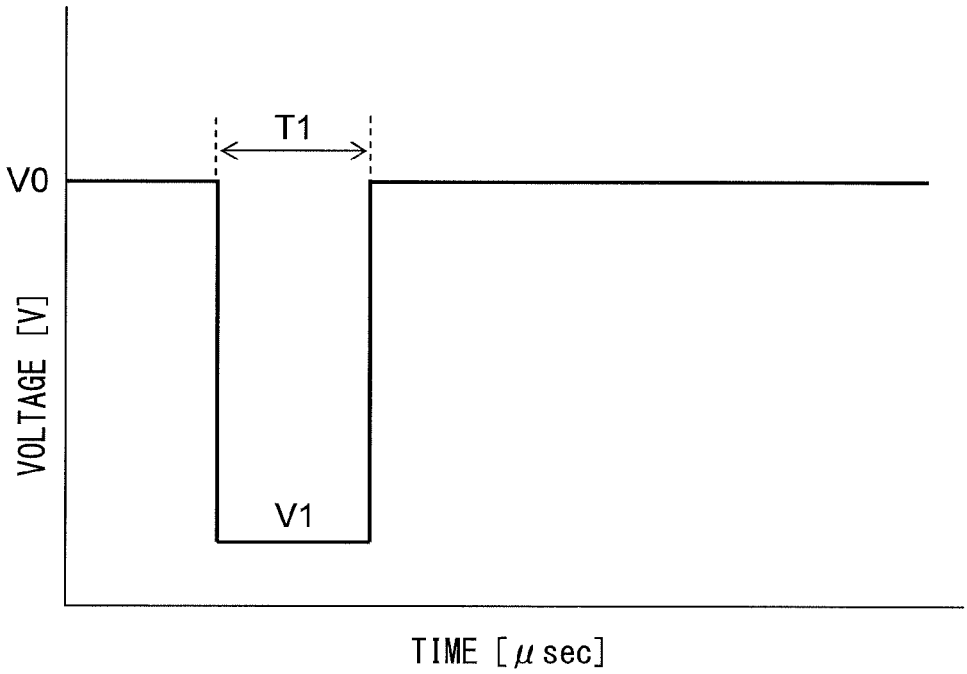
FIG. 5 is a waveform chart showing a first driving waveform as an ink discharge drive waveform.
Figure 9:
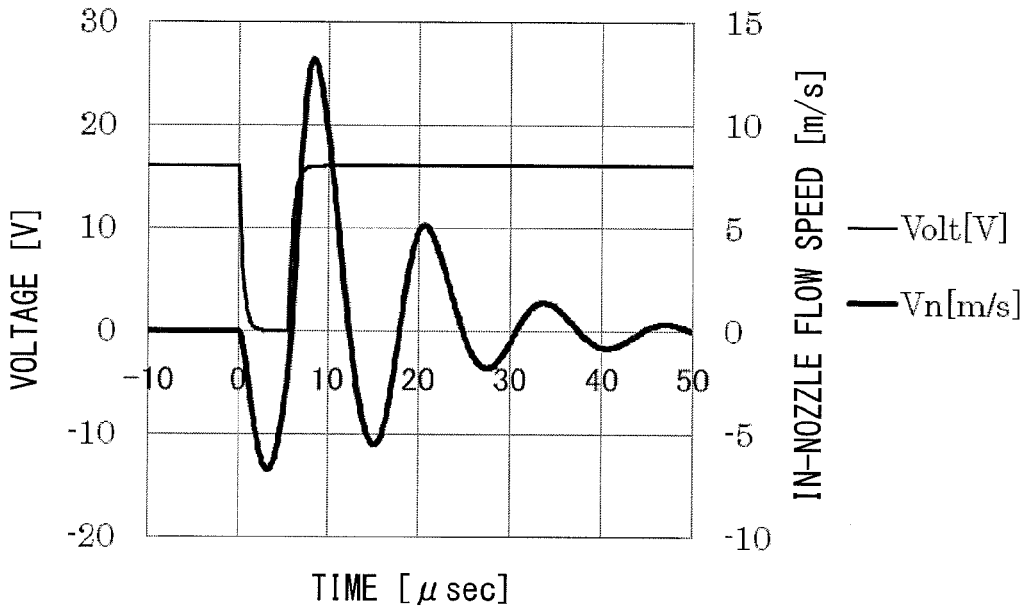
FIG. 9 is a chart showing a drive voltage applied to a piezoelectric element and ink flow speed inside a nozzle, when a first drive waveform is selected.

The first to third drive waveforms (1) to (3) are ink discharge drive waveforms, which are used for normal ink discharge and are prescribed respectively for different gradations (numbers of times that the nozzle 18 discharges ink) of a pixel constituting image data as the printing target. The first drive waveform (1) is a drive waveform corresponding to drive waveform selection data (ii) for a gradation value "1" whereby the head driver 25 makes the nozzle 18 of the recording head 17 discharge ink once per pixel. As shown in FIG. 5, prepared as the first drive waveform (1) is a waveform that falls from the voltage (V0) of the driving power source to a predetermined voltage (V1) lower than that, then stays there for the period of a pulse width T1, and then rises back to the voltage (V0) of the driving power source. When this first drive waveform (1) is applied to the piezoelectric element 31, as shown in FIG. 9, the ink flow speed inside the nozzle 18 exceeds 10 m/s once, and thus an ink droplet is discharged from the discharge port 18*a* once. In FIGS. 9 to 12, the drive voltage (Volt) is plotted by a fine line, and the ink flow speed (Vn) is plotted by a thick line.

Figure 6:
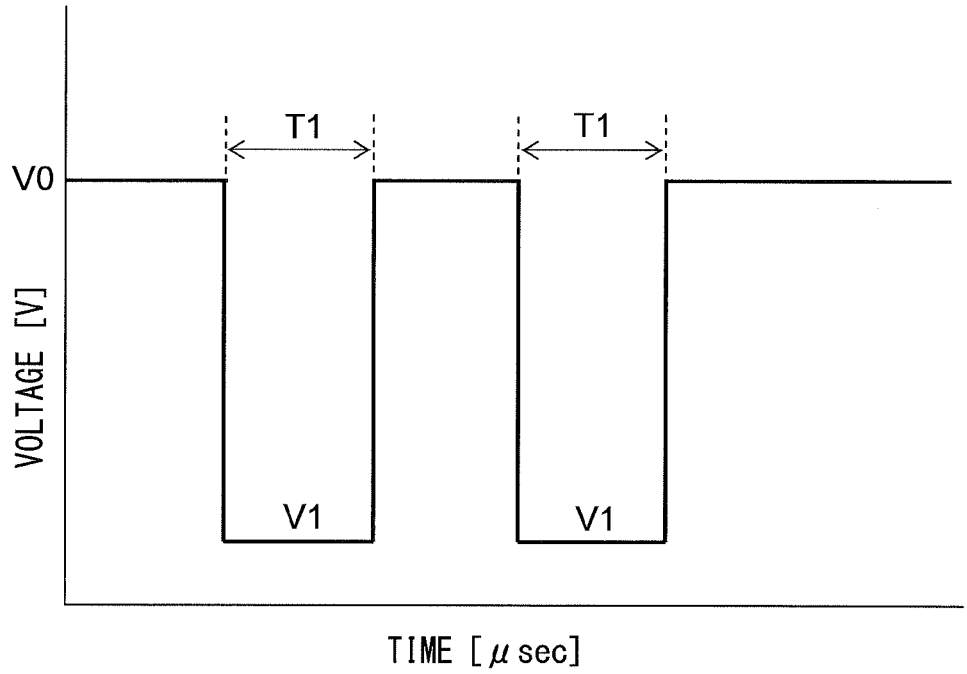
FIG. 6 is a waveform chart showing a second driving waveform as an ink discharge drive waveform.
Figure 10:
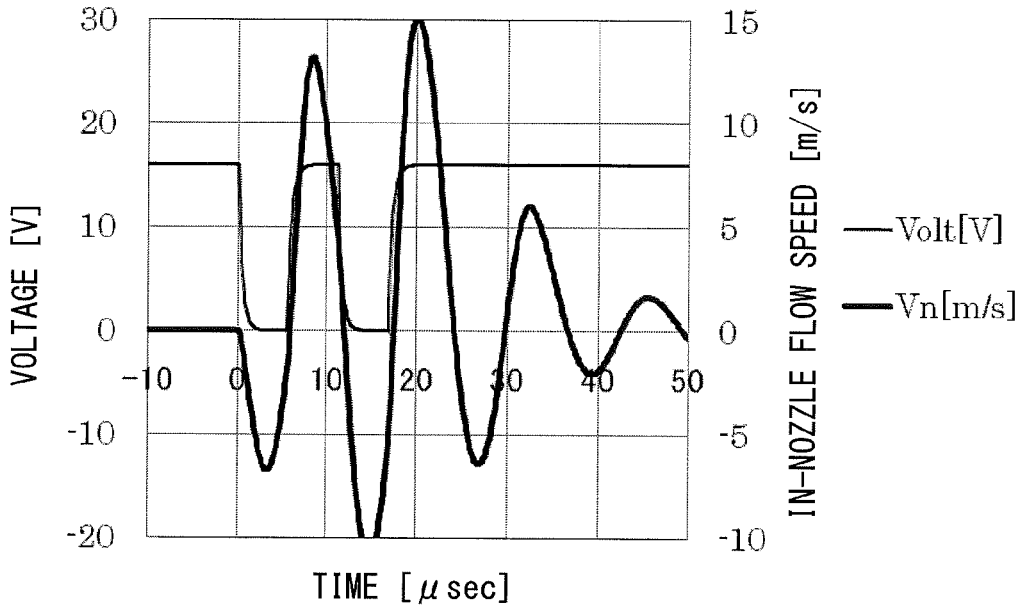
FIG. 10 is a chart showing a drive voltage applied to a piezoelectric element and ink flow speed inside a nozzle, when a second drive waveform is selected.

The second drive waveform (2) is a drive waveform corresponding to drive waveform selection data (ii) for a gradation value "2" whereby the head driver 25 makes the nozzle 18 of the recording head 17 discharge ink twice per pixel. As shown in FIG. 6, prepared as the second drive waveform (2) is a waveform that repeats twice the pulse of the first drive waveform (1) which falls from the voltage (V0) of the driving power source to a predetermined voltage (V1) lower than that, then stays there for the period of a pulse width T1, and then rises back to the voltage (V0) of the driving power source. When this second drive waveform (2) is applied to the piezoelectric element 31, as shown in FIG. 10, the ink flow speed inside the nozzle 18 exceeds 10 m/s twice, and thus an ink droplet is discharged from the discharge port 18*a* twice.

Figure 7:
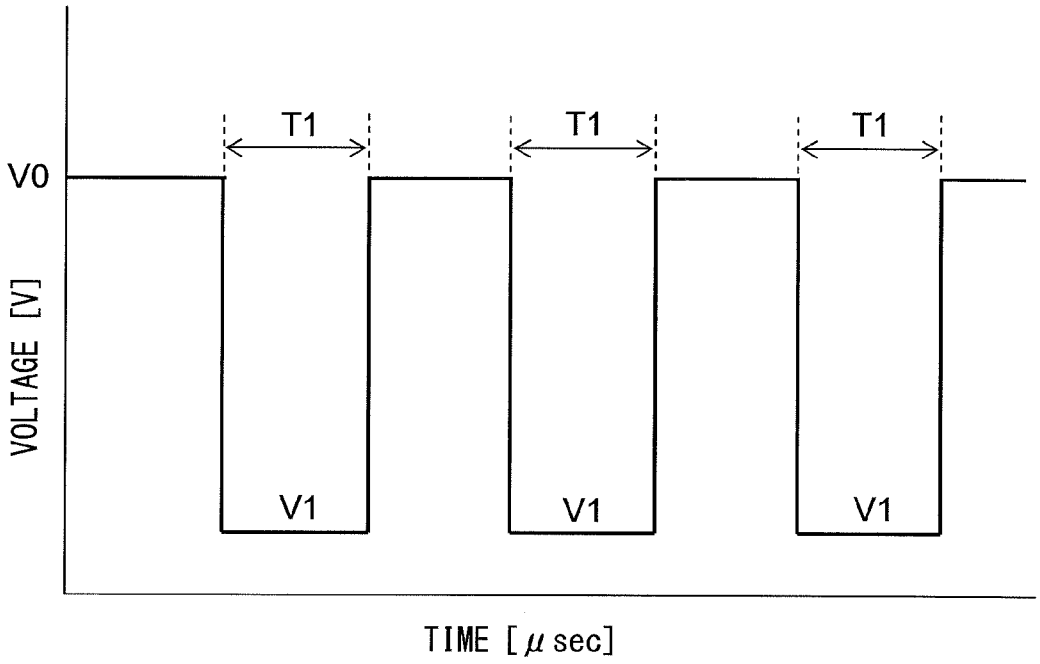
FIG. 7 is a waveform chart showing a third driving waveform as an ink discharge drive waveform.
Figure 11:
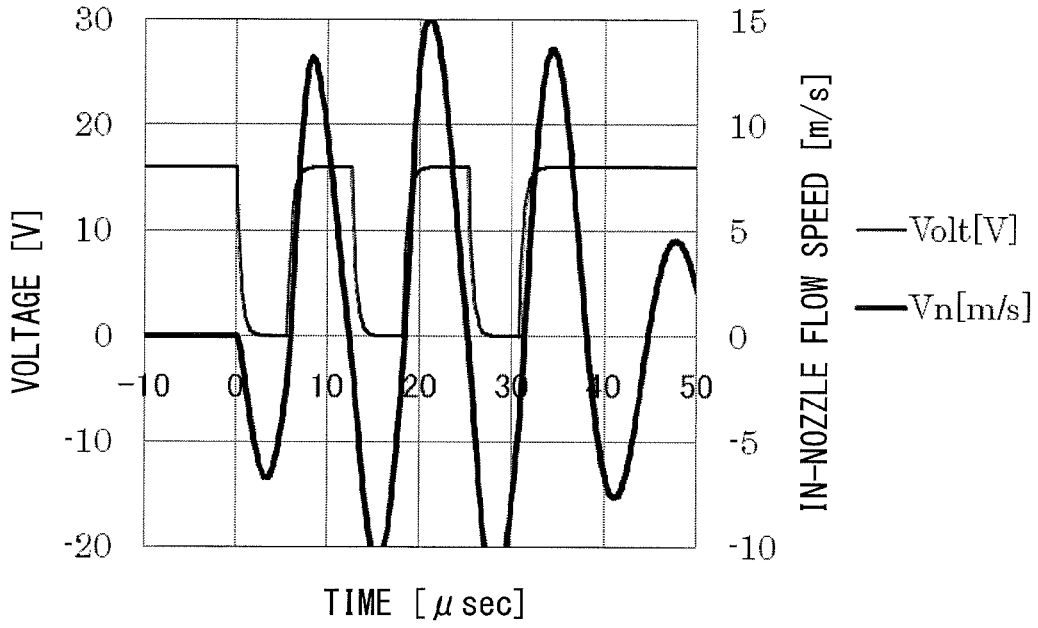
FIG. 11 is a chart showing a drive voltage applied to a piezoelectric element and ink flow speed inside a nozzle, when a third drive waveform is selected.

The third drive waveform (3) is a drive waveform corresponding to drive waveform selection data (ii) for a gradation value "3" whereby the head driver 25 makes the nozzle 18 of the recording head 17 discharge ink three times per pixel. As shown in FIG. 7, prepared as the third drive waveform (3) is a waveform that repeats three times the pulse of the first drive waveform (1) which falls from the voltage (V0) of the driving power source to a predetermined voltage (V1) lower than that, then stays there for the period of a pulse width T1, and then rises back to the voltage (V0) of the driving power source. When this third drive waveform (3) is applied to the piezoelectric element 31, as shown in FIG. 11, the ink flow speed inside the nozzle 18 exceeds 10 m/s three times, and thus an ink droplet is discharged from the discharge port 18*a* three times.

Figure 8:
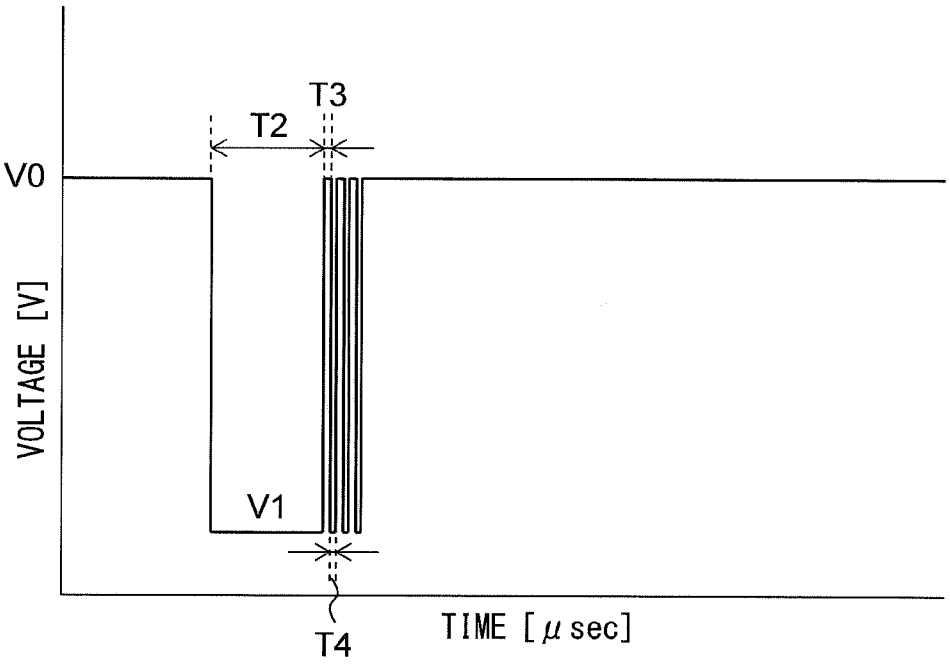
FIG. 8 is a waveform chart showing a fourth driving waveform as a meniscus swinging drive waveform.

By contrast, the fourth drive waveform (4) is a meniscus swinging drive waveform prescribed to enable the meniscus surface M to swing without discharging an ink droplet out of the nozzle 18, and is a waveform dissimilar from the first to third drive waveforms (1) to (3). As shown in FIG. 8, prepared as the fourth drive waveform (4) is a drive waveform that repeats a pulse having a narrower pulse width T2 than in the ink discharge drive waveforms (see FIGS. 5 to 7) a plurality of times successively at a higher frequency than in the ink discharge drive waveforms.

Figure 12:
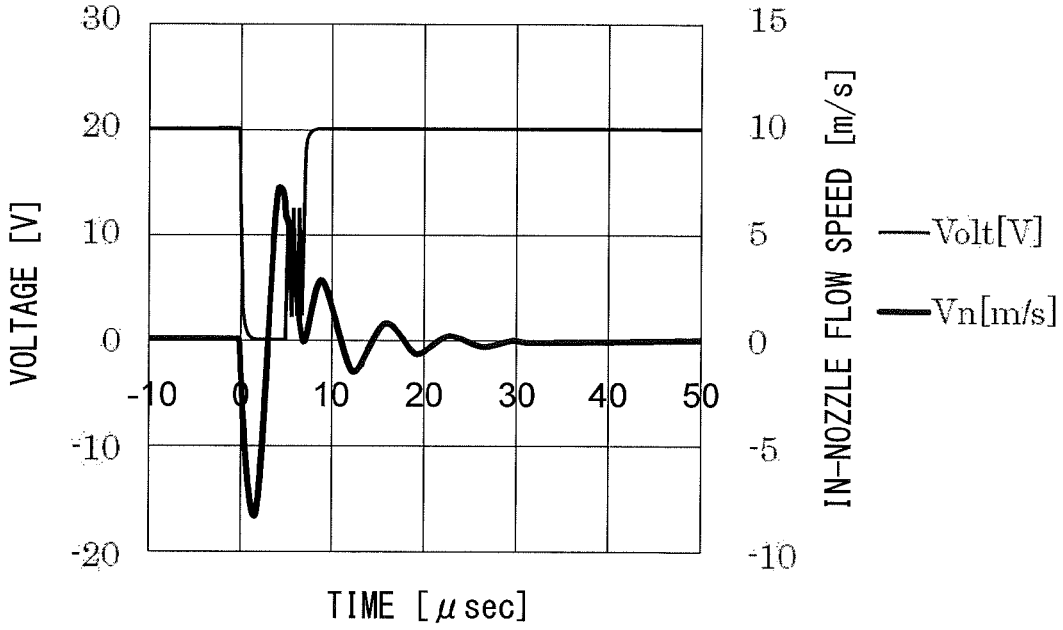
FIG. 12 is a chart showing a drive voltage applied to a piezoelectric element and ink flow speed inside a nozzle, when a fourth drive waveform is selected.

The fourth drive waveform (4) is, for example, a waveform that falls from the voltage (V0) of the driving power source to a predetermined voltage (V1) lower than that and stays there for the period of a pulse width T2 (a period equal to three quarters of the natural oscillation period of the recording head 17), then rises back to the voltage (V0) of the driving power source and stays there for the period of a pulse width T3 (a period equal to 1/10 to 1/13 of the natural oscillation period of the recording head 17), then repeats three times falling to the predetermined voltage (V1) lower than that and staying there for the period of a pulse width T4 (a period equal to 1/20 to 1/26 of the natural oscillation period of the recording head 17), and then rises back to the voltage (V0) of the driving power source. When this fourth drive waveform (4) is applied to the piezoelectric element 31, as shown in FIG. 12, the ink flow speed inside the nozzle 18 does not exceed 10 m/s, and thus the meniscus surface M does swing, but discharges no ink droplet.

Preferably, the swinging of the meniscus surface M by use of the fourth drive waveform (4) is performed not only for nozzles immediately before dot formation but also, between sheets during continuous printing, for all nozzles 18 that are to discharge ink at least once onto the subsequent sheet. The number of times to swing the meniscus surface M (the number of pulses in the fourth drive waveform (4) applied to the piezoelectric element 31) between sheets needs to be such that, even when the ink liquid near the discharge port 18*a* has come to have increased viscosity due to uneven distribution of ink liquid in the nozzle 18, the ink liquid inside the nozzle 18 is stirred anew by the meniscus swinging sufficiently not to cause ink clogging; thus, preferably, the meniscus surface M is swung 100 times or more.

If the meniscus surface M of a nozzle 18 immediately before dot formation is swung too greatly, an ink droplet may be formed that is so fine and has so low flying speed as to be recognized as dust on an image. However, by making the pulse width T2 of the fourth drive waveform (4) smaller than the natural oscillation period of the recording head 17, it is possible to prevent formation of too fine an ink droplet when the meniscus surface M is swung.

Next, a detailed description will be given of how the ink discharge by the recording head 17 is controlled in the inkjet recording apparatus 100 according to the present disclosure. According to the present disclosure, for a nozzle 18 that discharges ink for one pixel or less (0 or 1 pixel) within one set of (one page-worth) image data, preparatory discharge (waste printing) is performed by selecting the first drive waveform (1), which corresponds to the minimum gradation, out of the different ink discharge drive waveforms.

As described previously, in a nozzle 18 that has not discharged ink for a while, ink comes to have increased viscosity, and this may inconveniently lead to ink clogging at the discharge-start pixel (the first pixel that the nozzle 18 discharges ink for). As a remedy, for a nozzle 18 that discharges little ink, preparatory discharge is performed to discharge ink with increased viscosity. This helps suppress ink clogging on the subsequent and following pages (sheets), and thus helps form dots reliably.

Specifically, for a nozzle 18 that discharges ink for one pixel or less (0 or 1 pixel) within one set of (one page-worth) image data, as the drive waveform for a given pixel, the first drive waveform (1), which corresponds to the minimum gradation, is selected out of the ink discharge drive waveforms. Thus, for a pixel corresponding to a gradation value "0" for which no ink is supposed to be discharged, the first drive waveform (1) corresponding to the gradation value "1" is selected, and ink is discharged. In this way, ink with increased viscosity in the nozzle 18 can be discharged, and this helps suppress ink clogging on the subsequent and following pages (sheets). This preparatory discharge is performed on paper, but since it involves ink discharge corresponding to the minimum gradation among the ink discharge drive waveforms, it only leaves a hardly noticeable dot.

For a nozzle 18 that discharges ink for one pixel within one set of (one page-worth) image data, preparatory discharge needs to be performed once (for one pixel); also, for a nozzle 18 that discharges ink for no (zero) pixel (discharges no ink) within one set of (one page-worth) image data, preparatory discharge has only to be performed once (for one pixel). The reason is as follows. Between sheets during continuous printing, for all nozzles 18 that discharge ink at least once on the subsequent sheet, meniscus swinging is performed. Thus, a nozzle 18 that discharges ink for one pixel within one set of (one page-worth) image data has ink with increased viscosity in a larger volume; thus, discharging ink for one pixel is not sufficient to discharge all the ink with increased viscosity, and thus further preparatory discharge is needed. By contrast, a nozzle 18 that discharges ink for no (zero) pixel (discharges no ink) within one set of (one page-worth) image data has ink with increased viscosity in a comparatively small volume; thus, performing preparatory discharge once is sufficient to discharge all the ink with increased viscosity.

According to the present disclosure, to suppress recognition of preparatorily discharged dots by the human eye, preparatory discharge is performed in a fashion dispersed in the sub scanning direction.

Figure 13:
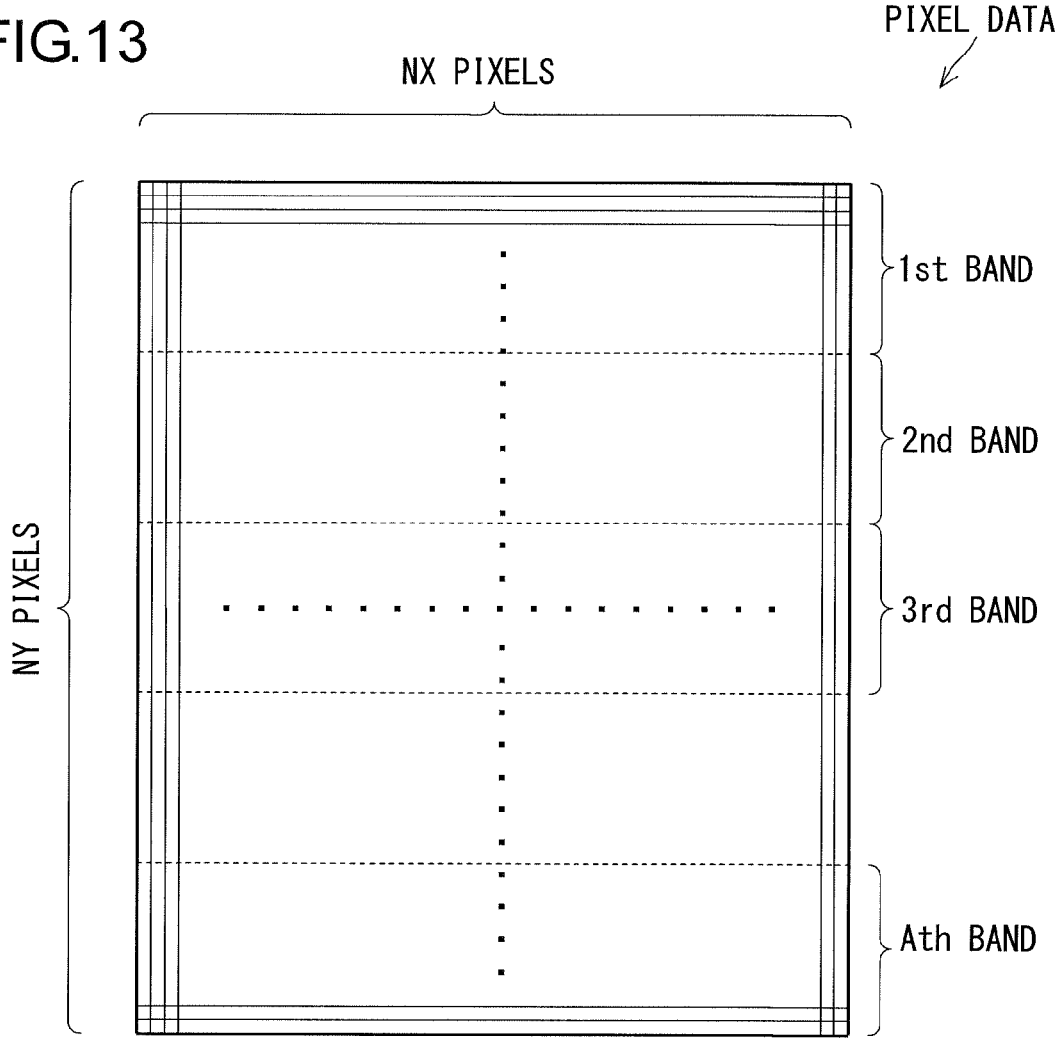
FIG. 13 is a diagram showing image data divided in a sub scanning direction into A bands.
Figure 14:
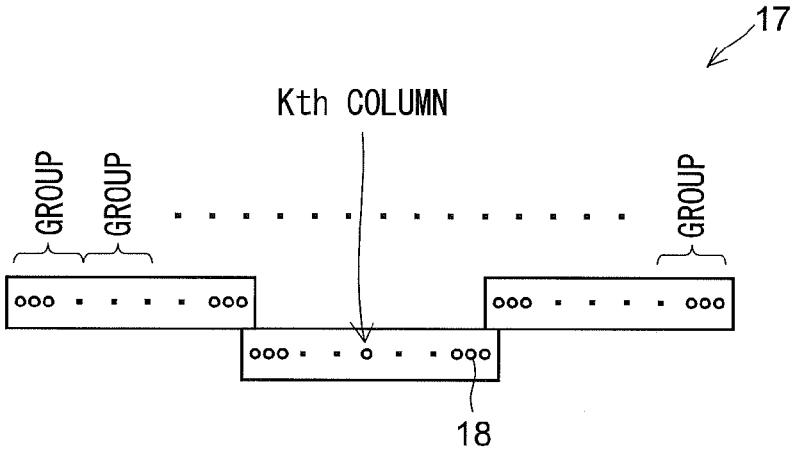
FIG. 14 is a diagram showing nozzles divided in a main scanning direction into groups each including A columns.

Specifically, suppose that, as shown in FIG. 13, with respect to one set of image data, the number of pixels in the main scanning direction equals NX, and the number of pixels in the sub scanning direction equals NY. The one set of image data is divided in the sub scanning direction into A bands (where A is an integer of 2 or more), and as shown in FIG. 14, the nozzles 18 are divided in the main scanning direction into groups each including A nozzles 18 (A columns of nozzles 18). The selector 30 associates, within each group, the nozzles 18 in the first to Ath columns with the first to Ath bands with no overlap. When a nozzle 18 performs preparatory discharge, the preparatory discharge is performed within the band associated with that nozzle 18.

Figure 15:
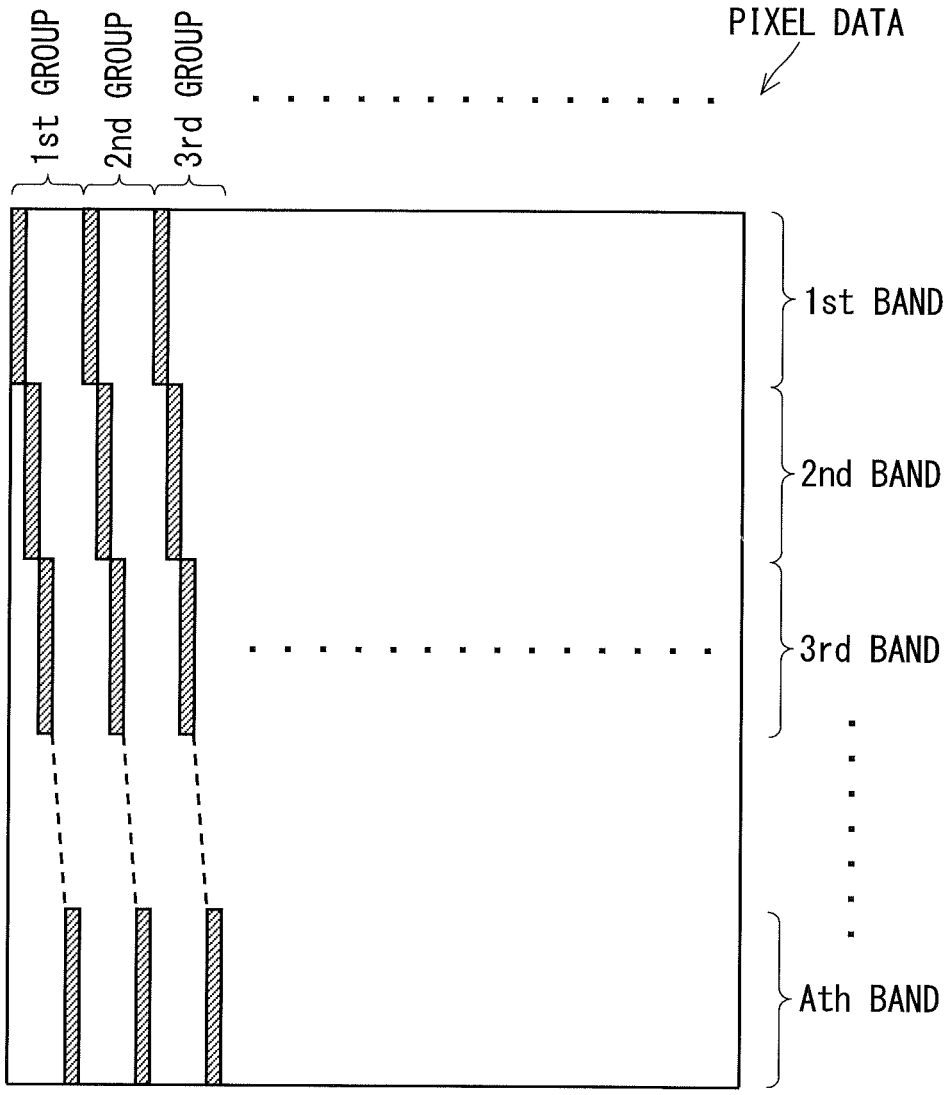
FIG. 15 is a diagram showing correspondence between nozzles and bands.

For example, when the remainder that is left when (K+α1) (where K is an integer from 1 to NX, and α1 is an integer of 0 or more) is divided by A is represented by M1, the selector 30 associates a nozzle 18 in the Kth column (see FIG. 14) with the M1th band (where M1 is an integer from 0 to A−1, but, when M1=0, with the Ath band). When α1=0, as shown in FIG. 15, within each group, a nozzle 18 in the first column is associated with the first band, a nozzle 18 in the second column is associated with the second band, . . . and a nozzle 18 in the Ath column is associated with the Ath band. The number of nozzles 18 in each recording head 17 is equal to the number of pixels NX in the main scanning direction in one set of image data.

Each band includes NB (≈NY/A) rows of pixels (where NB is an integer of 2 or more). The random number setter 28 sets random numbers in the range of 1 to NB to the nozzles 18 respectively. Then, for any nozzle 18 that discharges ink for one pixel or less within one set of image data, the selector 30 selects the first drive waveform (1) as the drive waveform for the pixels in the rows corresponding to the random numbers set by the random number setter 28 within the band associated with the nozzle 18. In this way, for each nozzle 18, the band and the row in which to perform preparatory discharge are set, so that the pixels at which preparatory discharge is performed is further dispersed in the sub scanning direction.

Since the recording heads 17 are provided for p colors (where p is an integer of 2 or more; in the embodiment, p=4), it is preferable that, for recording heads 17 of different colors, different bands be selected. For example, when the remainder that is left when (M1+q+α2) (where q and α2 are each an integer of 1 or more, with q in the range from 2 to p) is divided by A is represented by M2 (where M2≠M1), the selector 30 associates a nozzle in the Kth column of a recording head 17 of the qth color with the M2th band (but, when M2=0, with the Ath band). This prevents preparatory discharge from being performed in the same band by a nozzle 18 in the Kth column of a recording head 17 of the first color and a nozzle 18 in the Kth column of a recording head 17 of the qth color. It is preferable that all the recording heads 17 be associated with different bands.

Figure 16:
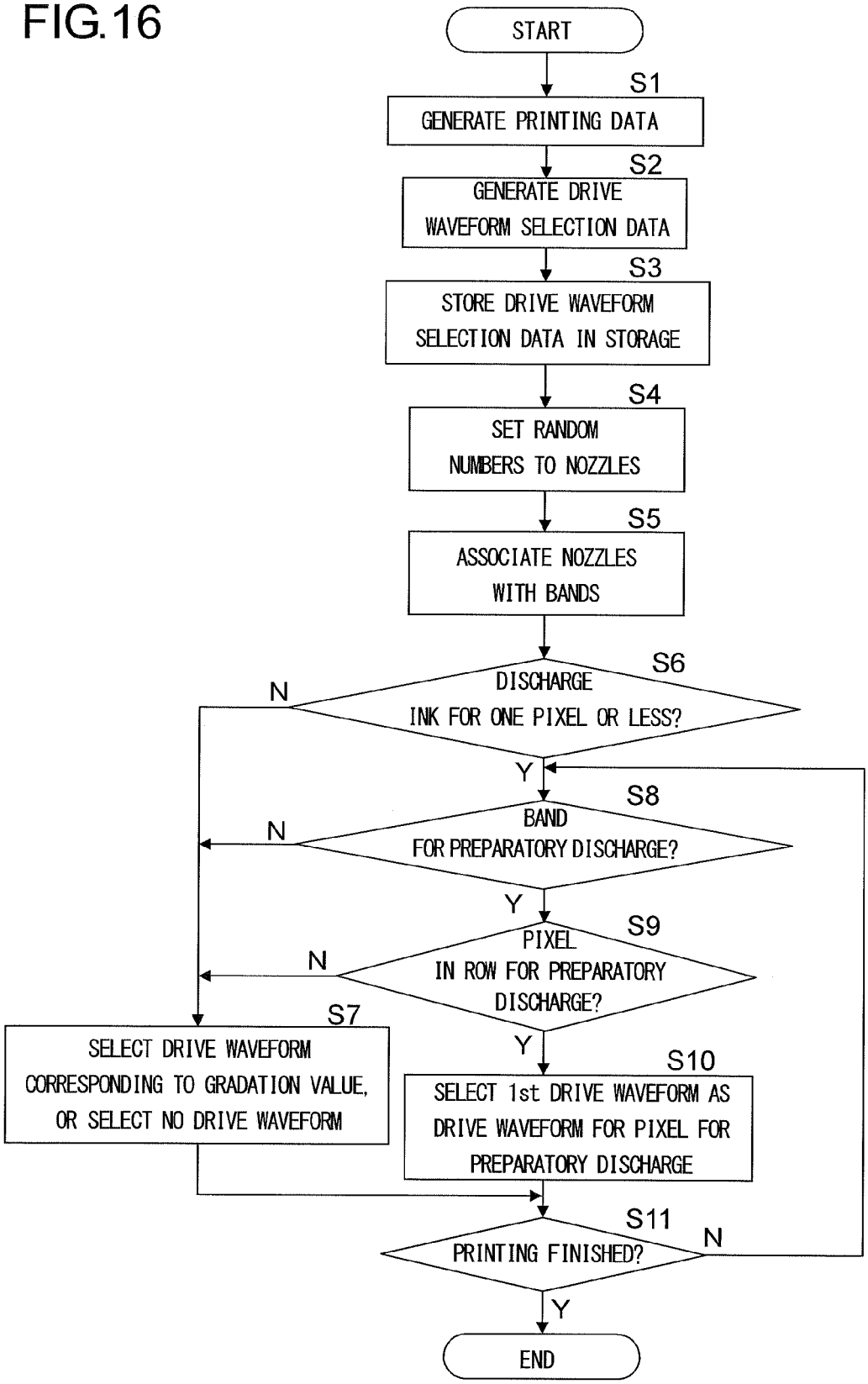
FIG. 16 is a flow chart showing a sequence of ink discharge operation by a recording head in an inkjet recording apparatus according to the present disclosure.

Next, with reference to FIGS. 1 to 4 as necessary, along the flow shown in FIG. 16, a description will be given of how ink is discharged when an image is recorded on the inkjet recording apparatus 100 according to the present disclosure.

In response to a print command received from a printer driver in a personal computer or the like, first, the image processor 21 in the controller 20 generates printing data (i) based on the received image data (step S1). Subsequently, the printing data (i) is transmitted to the data processor 23, which then generates, respectively for the pixels constituting the printing data (i), drive waveform selection data (ii) which indicates the number of times that the nozzles 18 corresponding to those pixels discharge ink (step S2).

In the embodiment, the recording head 17 can form dots in one of four gradations with the gradation values "0," "1," "2," and "3" respectively. The data processor 23 converts the 256-gradation printing data (i) into 4-gradation drive waveform selection data (ii), and then transmits the result to the storage 29 to store it there (step S3).

Thereafter, the random number setter 28 sets random numbers in the range of 1 to NB to the nozzles 18 respectively (step S4). The selector 30 then associates, within each group of nozzles 18, the nozzles 18 in the first to Ath columns with the first to Ath bands with no overlap (step S5).

Thereafter, the drive waveform corresponding to the drive waveform selection data (ii) for an Nth line of the image data is determined. Specifically, first, for each nozzle 18, it is checked whether or not ink is to be discharged for one pixel or less (0 or 1 pixel) within one set of (one page-worth) image data (step S6).

If, at step S6, it is determined that ink is discharged for two or more pixels within one set of (one page-worth) image data, an advance is made to step S7. Then, for each nozzle 18, as the drive waveform for a pixel for which ink is to be discharged, an ink discharge drive waveform corresponding to the gradation of that pixel is selected. For example, for pixels having the gradation values "1" to "3" among the pixels in the Nth line stored in the storage 29, the first to third drive waveforms (1) to (3) are selected respectively. For pixels having the gradation value "0," no dot formation is to be performed, and thus none of the drive waveforms is selected.

If, at step S6, it is determined that ink is discharged for one pixel or less within one set of (one page-worth) image data, an advance is made to step S8. Then, it is checked whether or not the pixels in the Nth line are in the band where preparatory discharge is to be performed (the band associated with the nozzle 18).

If, at step S8, it is determined that the band is not where preparatory discharge is to be performed, an advance is made to step S7. Then, either an ink discharge drive waveform is selected that corresponds to the gradation of the pixels, or no drive waveform is selected.

If, at step S8, it is determined that the band is where preparatory discharge is to be performed, an advance is made to S9. Then, it is checked whether or not the pixels in the Nth line are pixels in a row where preparatory discharge is to be performed (pixels in a row corresponding to a set random number).

If, at step S9, it is determined that the pixels are not those in a row where preparatory discharge is to be performed, an advance is made to step S7. Then, either an ink discharge drive waveform is selected that corresponds to the gradation of those pixels, or no drive waveform is selected.

If, at step S9, it is determined that the pixels are those in a row where preparatory discharge is to be performed, an advance is made to step S10. Then, as the drive waveform for a pixel at which to perform preparatory discharge, the first drive waveform (1) corresponding to the minimum gradation among the ink discharge drive waveforms is selected (step S10). Incidentally, when, at step S7 or S10, a drive waveform is selected for the pixels in the Nth line, the fourth drive waveform (4) is selected for the pixels in the (N−1)th line and preparatory discharge is performed.

Then, it is checked whether or not the above checks have been done for all the lines for all the recording heads 17 (step S11), and if any line still remains to be checked, the procedure from step S8 through step S11 is repeated for the next line.

Incidentally, it can happen that, with respect to a nozzle 18 that discharges ink for one pixel within one set of (one page-worth) image data, a pixel where to discharge ink and a pixel where to perform preparatory discharge coincide. In such a case, it is preferable to start the setting all over again with alterations made in the bands and rows where to perform preparatory discharge.

In the embodiment, as described above, for a nozzle 18 that discharges ink for one pixel or less within one set of (one page-worth) image data, the selector 30 makes the nozzle 18 perform preparatory discharge by selecting a drive waveform corresponding to the minimum gradation out of the ink discharge drive waveforms within the band associated with the nozzle 18. In this way, a nozzle 18 that discharges little ink can be made to perform preparatory discharge (waste printing) to discharge ink with increased viscosity. This helps suppress ink clogging on the subsequent and following pages (sheets), and helps stabilize ink discharge from the nozzles 18. Since, in this inkjet recording apparatus 100, preparatory discharge is performed on paper, it is not necessary to wipe ink off the recording heads 17.

Moreover, since the selector 30 selects the first drive waveform (1) corresponding to the minimum gradation out of the ink discharge drive waveforms, it is possible to minimize the size of the dots formed by preparatory discharge. This helps suppress recognition of the preparatorily discharged dots by the human eye, and thus helps suppress degradation in image quality.

Moreover, the selector 30 associates, within each group, the nozzles 18 in the first to Ath columns with the first to Ath bands with no overlap. Thus, it never occurs that neighboring nozzles 18 perform preparatory discharge in the same band. That is, it never occurs that preparatorily discharged dots are formed continuously in the main scanning direction. This helps prevent preparatorily discharged dots from being recognized as a line, and thus helps further suppress degradation in image quality. Moreover, by associating A nozzles 18 with A bands with no overlap, it is possible to perform preparatory discharge in a fashion dispersed in the sub scanning direction. This helps further suppress recognition of the preparatorily discharged dots by the human eye, and thus helps further suppress degradation in image quality.

Moreover, as described above, for a nozzle 18 that discharges ink for one pixel or less within one set of (one page-worth) image data, the selector 30 makes the nozzle 18 perform preparatory discharge by selecting, as the drive waveform for the pixels in a row corresponding to a random number set by the random number setter 28, the drive waveform corresponding to the minimum gradation out of the ink discharge drive waveforms within the band associated with the nozzle 18. This helps perform preparatory discharge in a fashion further dispersed in the sub scanning direction, and thus helps further suppress degradation in image quality.

Moreover, when, as described above, the remainder that is left when ($K+\alpha 1$) is divided by A is represented by M1, the selector 30 associates a nozzle 18 in the Kth column with the M1th band (but, when M1=0, with the Ath band). In this way, the bands in which neighboring nozzles 18 perform preparatory discharge can be displaced one band from each other. This makes it possible to easily associate the nozzles 18 in the first to Ath columns with the first to Ath bands with no overlap.

Moreover, when, as described above, the remainder that is left when ($M1+q+\alpha 2$) is divided by A is represented by M2 (where $M2 \neq M1$), the selector 30 associates a nozzle 18 in the Kth column of a recording head 17 of the qth color with the M2th band (but, when M2=0, with the Ath band). This helps prevent preparatory discharge from being performed in the same band by a nozzle 18 in the Kth column of a recording head 17 of the first color and a nozzle 18 in the Kth column of a recording head 17 of the qth color. This helps perform preparatory discharge in a further dispersed fashion, and thus helps further suppress degradation in image quality. By associating all the recording heads 17 with different bands, it is possible to perform preparatory discharge in a further dispersed fashion.

Moreover, as described above, between sheets during continuous printing, a drive voltage having the meniscus swinging drive waveform is applied to all piezoelectric elements 31 that discharge ink for one pixel or more. This helps more effectively prevent nozzle clogging and ink discharge failure.

Next, a description will be given of confirmation experiments conducted to confirm the effect of the embodiment described above. The confirmation experiments were conducted with Practical Examples 1 to 4, which reflect the embodiment described above, and Comparative Example 1.

DESCRIPTION COMMON TO PRACTICAL EXAMPLES 1 TO 4 AND COMPARATIVE EXAMPLE 1

Preparing a Pigment Dispersion

For improved image quality, suitably usable is a pigment dispersion in a form of fine particles coated by a resin having a molecular weight of several tens of thousands. Suitable as such resin materials are resins with acid values in the range of 150 to 300, examples including water-soluble resins such as styrene acrylic resin. Too low an acid value leads to poor pigment dispersion, difficulty producing fine particles, and dull and weak coloring. On the other hand, too high an acid value leads to poor storage stability of ink.

Used in the confirmation experiments was a mixture of a well-known pigment (15% by mass) such as phthalocyanine blue, a water-soluble resin (alkali-soluble resin) (1.5 to 6.75% by mass) neutralized with an equivalent amount of KOH, olefin E1010 (0.5% by mass), and water (83 to 77.75% by mass), blended in the proportion given in parentheses. The mixture was then kneaded on a medium disperser.

Used as the disperser was a wet-type disperser (examples including a Nano-Grain Mill manufactured by Asada Iron Works. Co., Ltd., an MSC Mill manufactured by Mitsui Kozan Co., Ltd., and a Dyno-Mill manufactured by Shinmaru Enterprises Corporation). The product was then processed, using small-diameter beads (zirconia beads of diameters 0.5 mm and 1.0 mm), to have an average particle diameter in the range of 70 to 130 nm. Incidentally, by varying the bead diameter, it is possible to vary the degree of dispersion and the amount of isolated resin; using beads with smaller diameters not only helps obtain finer particles but also helps strengthen the coating by the resin with respect to the pigment. Grain size distribution can be measured by analyzing a solution diluted with ion exchange water in the ratio of 1:300 on a tester such as a Zeta Sizer Nano manufactured by Sysmex Corporation.

[Preparing Ink]

Then the obtained pigment dispersion (26.6% by mass) was mixed and stirred with olefin E1010 (0.5% by mass), 1,3-butanediol (5.0% by mass), triethyleneglycol monobutylether (5.0% by mass), 2-pyrolidone (5.0% by mass), glycerin (15.0% by mass), and ion exchange water (42.9% by mass), blended in the proportion given in parentheses. Thus, ink was prepared. The obtained ink had a viscosity of about 6 mPa·s.

Practical Example 1

A recording head 17 was charged with the prepared ink. Then, for all the nozzles 18, purging was performed (so that ink with increased viscosity was discharged), and then wiping was performed (so that discharged ink was wiped off). Thereafter, an A3-size sheet of paper was transported, and in a rear-end part of the sheet, ink was discharged for one pixel from all the nozzles 18. In Practical Example 1, the amount of ink discharged was 5.5 pl, which corresponded to the gradation value "1" (the first drive waveform (1)).

The meniscus swinging between sheets included 300 swings, and the meniscus swinging immediately before discharge (dot formation) included 5 swings. The frequency of swings was 20,000 swings per second.

Practical Example 2

A recording head 17 was charged with the prepared ink, and then, for all the nozzles 18, purging and wiping were performed. Thereafter, a sequence of transporting an A3-size sheet of paper and discharging, in a rear-end part thereof, ink for one pixel from all the nozzles 18 was repeated continuously for one hour. That is, a sequence of, on every A3-size sheet, discharging ink for one pixel and performing preparatory discharge once (for one pixel) was performed for one hour. In other respects, Practical Example 2 was similar to Practical Example 1.

Practical Example 3

A recording head 17 was charged with the prepared ink, and then, for all the nozzles 18, purging and wiping were performed. Thereafter, A3-size sheets of paper were transported continuously without printing until, one hour later, a solid pattern was printed. That is, an operation of, on every A3-size sheet, performing preparatory discharge once (for one pixel) was repeated for one hour, and then a solid pattern was printed. In other respects, Practical Example 3 was similar to Practical Example 1.

Then, with respect to Practical Examples 1 and 2, the dots printed on the sheets were evaluated, and with respect to Practical Example 3, the solid pattern printed on the sheets was evaluated. The results are shown in Table 1 below. For Practical Examples 1 and 2, "GOOD" indicates satisfactory printing results, and "NG" indicates unsatisfactory printing results. For Practical Example 3, in comparison with a solid pattern printed with no (0) non-printing period, "GOOD" indicates a drop in density less than 0.04, and "NG" indicates a drop in density of 0.04 or more.

TABLE 1

| | |
|---|---|
| Practical Example 1 | GOOD |
| Practical Example 2 | GOOD |
| Practical Example 3 | GOOD |

Referring to Table 1, the result of Practical Example 1 confirms that, immediately after purging and wiping, even when there is an A3-size unprinted region, no ink clogging occurs. The result of Practical Example 2 confirms that, even when ink is discharged for only one pixel within one set of (one page-worth) image data, if preparatory discharge is performed once (for one pixel) per page, no ink clogging occurs. The result of Practical Example 3 confirms that, even when ink is discharged for only one pixel per hour, if preparatory discharge is performed once (for one pixel) per page, no ink clogging occurs.

Thus, it has been confirmed that, even when there is a long time interval during which no ink is discharged or little printing is performed, by performing preparatory discharge once (for one pixel) per page, it is possible to discharge ink stably.

Practical Example 4

A recording head 17 was charged with the prepared ink, and for all the nozzles 18, purging and wiping were performed. Thereafter, preparatory discharge was performed by the ink discharge method as in the embodiment described previously. That is, the nozzles 18 were associated with bands respectively, and were respectively assigned random numbers in the range of 1 to NB, so that preparatory discharge was performed in a fashion dispersed in the sub scanning direction. In other respects, Practical Example 4 was similar to Practical Example 1.

Comparative Example 1

In Comparative Example 1, preparatory discharge was performed without dispersion in the sub scanning direction. That is, for all the nozzles 18, preparatory discharge was performed for pixels in the same row within the same band. In other respects, Comparative Example 1 was similar to Practical Example 4.

With respect to Practical Example 4 and Comparative Example 1, sheets on which preparatory discharge was performed were evaluated through visual inspection by 100 people, male and female, in their teens to fifties, at a distance of about 50 cm from the sheets. The results are shown in Table 2 below. "GOOD" indicates that no person recognized any dot of preparatory discharge, and "NG" indicates that at least one person recognized a dot of preparatory discharge.

TABLE 2

| | |
|---|---|
| Practical Example 4 | GOOD |
| Comparative Example 1 | NG |

Referring to Table 2, it has been confirmed that, by performing preparatory discharge in a fashion dispersed in the sub scanning direction, it is possible to suppress recognition of dots by the human eye.

In an experiment with respect to Comparative Example 2, where, as described below, the image data was not divided into A bands in the sub scanning direction, dots were recognizes as lines. Superficially, in Comparative Example 2, random numbers in the range of 1 to 7016 (the number of pixels along the longer side of an A4-size sheet at 600 dpi) were generated by a well-known method, these random numbers were set to 4961 nozzles 18 (the number of pixels along the shorter side of an A4-size sheet), and preparatory discharge was performed for pixels corresponding to the set random numbers. Then, by visual inspection, dot recognizability was evaluated. This experiment (involving random number assignment to dot recognizability evaluation) was conducted on 100 different images. The results: on 10 different images, dots were recognized as lines.

It should be understood that the embodiment disclosed herein is in every respect illustrative and not restrictive. The scope of the present disclosure is defined not by the description of the embodiment given above but by the appended claims, and encompasses any modifications and variations made in the sense and scope equivalent to those of the claims.

For example, in the embodiment described above, the drive waveform selection data (ii) generated in the data processor 23 has four gradations, with the gradation values "0" to "3" respectively. This, however, is not meant as a limitation. The drive waveform selection data (ii) can have two gradations, i.e., "0" and "1," or three gradations, i.e., "0," "1," and "2," or five or more gradations. In such cases, the different drive waveforms generated in the drive pulse generator 27 are set to suit the drive waveform selection data (ii).

The number of nozzles 18, the nozzle interval, etc. in a recording head 17 can be set appropriately according to the specifications of the inkjet recording apparatus 100. There is no particular restriction, either, in the number of recording heads 17 in each line head 11C to 11K; one recording head 17, or four or more recording heads 17, can be arranged in each line head 11C to 11K.

The embodiment described above deals with an example where, as shown in FIG. 15, the bands in which neighboring nozzles 18 perform preparatory discharge are displaced one band from each other. This, however, is not meant as a limitation. The bands in which neighboring nozzles 18 perform preparatory discharge can be displaced two or more bands from each other. Or the nozzles 18 can be randomly associated with the bands with no overlap within each group.

The embodiment described above deals with an example where meniscus swinging is performed for all the nozzles 18 immediately before discharge (dot formation). This, however, is not meant as a limitation. Meniscus swinging does not necessarily have to be performed for nozzles 18 immediately before discharge. Or, meniscus swinging can be performed only for nozzles 18 that have not discharged ink for a predetermined number of pixels or more consecutively. Even in that case, it is possible to suppress ink clogging and ink discharge failure in the nozzles 18.

The embodiment described above deals with an example where recording heads 17 for four colors are provided. This, however, is not meant as a limitation. Recording heads 17 for a single color (black) alone can be provided.

The embodiment described above deals with an example where the random number setter 28 is provided in the head driver 25. This, however, is not meant as a limitation. The random number setter 28 can be provided, for example, in the controller 20. In that case, after random numbers are set in the random number setter 28, the data of the set random numbers can be, together with the drive waveform selection data (ii), transmitted to the storage 29.

The embodiment described above deals with an example where, after 256-gradation printing data (i) is converted into 4-gradation drive waveform selection data (ii) in the data processor 23, the result is transmitted to and stored in the storage 29, and the control thereafter is performed in the head driver 25. This, however, is not meant as a limitation. The control after the printing data (i) is converted into the drive waveform selection data (ii) (steps S4 through S11) can be performed in the data processor 23. A configuration is also possible where the conversion of the printing data (i) into the drive waveform selection data (ii) and the subsequent switching of the drive waveform selected for given pixels are performed in the data processor 23, then the data after the switching is transmitted to the storage 29, and the control thereafter is performed in the head driver 25. Here, for example, the selector 30 can be provided in the controller 20, or can be provided in the head driver 25 and the controller 20.

The embodiment described above deals with an example where the data processor generates drive waveform selection data that indicates the number of times that ink is discharged corresponding to the gradations of pixels. This, however, is not meant as a limitation. The data processor can generate drive waveform selection data that indicates the ink discharge amount or the ink discharge speed corresponding to the gradations of pixels.

What is claimed is:

1. An inkjet recording apparatus comprising:

a recording head having a plurality of nozzles for discharging ink onto a recording medium, a plurality of pressurizing chambers communicating with the plurality of nozzles respectively and capable of containing the ink inside, and a plurality of piezoelectric elements arranged to correspond to the plurality of pressurizing chambers respectively, the piezoelectric elements pressurizing the ink inside the pressurizing chambers to discharge the ink from the nozzles respectively;

a head driver including a drive pulse generator which generates, as a drive waveform of drive voltages for the piezoelectric elements, one of a plurality of drive waveforms including two or more ink discharge drive waveforms set according to a number of times that the nozzles are to discharge the ink, and a meniscus swinging drive waveform for swinging meniscuses inside the nozzles without discharging the ink, the head driver making the nozzles discharge amounts of ink determined respectively according to gradations of pixels constituting image data as a printing target; and a controller having an image processor for generating printing data in which the pixels constituting the image data as the printing target are represented in multivalued gradations respectively, and a data processor for generating, respectively for the pixels constituting the printing data generated in the image processor, drive waveform selection data corresponding to the gradations of the pixels, wherein in at least one of the head driver and the controller, a selector is provided which selects, for the nozzles respectively, which of the drive waveforms to apply, or whether or not to apply any of the drive waveforms, to the piezoelectric elements, and when one set of image data is divided in a sub scanning direction into A bands (where A is an integer of 2 or more), and the nozzles are divided in a main scanning direction into groups each comprising A nozzles, the selector associates, within each of the group, the nozzles in first to Ath columns with first to Ath bands with no overlap, and for a nozzle that is to discharge ink for one pixel or less within the one set of image data, makes the nozzle perform preparatory discharge by selecting, out of the ink discharge drive waveforms, a drive waveform corresponding to a minimum gradation within the band associated with the nozzle.

2. The inkjet recording apparatus according to claim 1, further comprising a random number setter which sets random numbers in a range of 1 to NB (where NB is an integer of 2 or more) to the nozzles respectively, wherein each of the bands comprises NB rows of pixels in the sub scanning direction, and the controller, for a nozzle that is to discharge ink for one pixel or less within the one set of image data, makes the nozzle perform preparatory discharge by selecting, out of the ink discharge drive waveforms, a drive waveform corresponding to a minimum gradation as a drive waveform for pixels in the rows corresponding to the random numbers set by the random numbers within the band associated with the nozzle.

3. The inkjet recording apparatus according to claim 1, wherein when a remainder that is left when (K+$\alpha$1) (where K is an integer of 1 or more, and $\alpha$1 is an integer of 0 or more) is divided by A equals M1, the selector associates nozzles in a Kth column with an M1th band (but, when M1=0, with an Ath band).

4. The inkjet recording apparatus according to claim 3, wherein when a remainder that is left when (M1+q+$\alpha$2) (where q and $\alpha$2 are each an integer of 1 or more, with q in the range from 2 to p) is divided by A equals M2 (where M2≠M1), the selector associates nozzles in a Kth column of the recording head of a qth color with an M2th band (but, when M2=0, with an Ath band).

5. The inkjet recording apparatus according to claim 1, wherein between sheets of the recording medium during continuous printing, a drive voltage having the meniscus swinging drive waveform is applied to all piezoelectric elements that are to discharge ink for one pixel or more on a subsequent sheet of the recording medium.

6. The inkjet recording apparatus according to claim 1, wherein for a nozzle that has not discharged ink for a predetermined number of pixels or more consecutively, meniscus swinging is performed immediately before ink discharge.

* * * * *